United States Patent [19]

Wahlers

[11] Patent Number: 4,718,142

[45] Date of Patent: Jan. 12, 1988

[54] GAS DRIVEN PIPE CLEANER AND REEL

[75] Inventor: Ronald L. Wahlers, Cape Girardeau, Mo.

[73] Assignee: D.W. Tool, Inc., Cape Girardeau, Mo.

[21] Appl. No.: 892,764

[22] Filed: Jul. 31, 1986

[51] Int. Cl.[4] ..... A47L 5/14

[52] U.S. Cl. ..... 15/395; 15/315; 15/387; 15/406; 15/104.061

[58] Field of Search ..... 15/406, 387, 104.06 R, 15/104.12, 315, 405, 316 R, 320, 321, 395; 141/4, 38, 231

[56] References Cited

U.S. PATENT DOCUMENTS

| | | | |
|---|---|---|---|
| 666,799 | 1/1901 | Buckwalter | 15/406 |
| 1,587,194 | 6/1926 | Sladden | 15/104.12 X |
| 1,628,070 | 5/1927 | Sladden | 15/104.12 |
| 2,336,293 | 12/1943 | Pletcher | 15/104.12 |
| 2,640,724 | 6/1953 | Sanders et al. | 15/320 X |
| 2,735,794 | 2/1956 | Pletcher | 15/104.12 X |
| 3,321,184 | 5/1967 | Goss | 15/104.12 X |
| 3,335,766 | 8/1967 | Winger | 141/38 |
| 3,755,841 | 9/1973 | Goethe et al. | 15/405 X |

FOREIGN PATENT DOCUMENTS

| | | | |
|---|---|---|---|
| 2064410 | 7/1971 | Fed. Rep. of Germany | 15/387 |
| 293093 | 6/1971 | U.S.S.R. | 15/387 |

*Primary Examiner*—Chris K. Moore

*Attorney, Agent, or Firm*—Glenn K. Robbins

[57] ABSTRACT

A gas driven cleaning apparatus for clearing clogged pipe lines or the like. The apparatus is comprised of a gas driven nozzle having specially devised gas passages for aiding the propulsion of the nozzle through and clearing the clogged area. A flexible hose is connected to the nozzle and a high pressure gas cylinder supported on a two wheel hand cart. The hand cart has a main hose reel and handle for a first gas line and a portable hand reel which supports a second gas line connected to the main reel line and the nozzle at opposite ends. The hand reel may be carried apart from the hand cart to difficultly accessible or remote areas not approachable by the hand cart. In a modification the nozzle is provided with a rotary head element powered by the high pressure gas.

10 Claims, 8 Drawing Figures

GAS DRIVEN PIPE CLEANER AND REEL

BACKGROUND OF THE INVENTION

In the material handling industry, for movement of discrete particles of material through pipe line problems have been encountered with the clogging of lines. Such materials as grain, discrete particle chemicals and various industrial materials are continually moved through such lines by high pressure gas, gravity and other physical means.

The clearing of clogged obstructions which can occur from various means causes damage in down time of the line and interruption of service and cost and labor in clearing the line. One such manner of clearing a clogged line has entailed the breaking apart of line or pipe sections and employing a drill inserted through an open end of the clogged section to drill out the clogged area. Such a method of clearing a line entails extensive time and labor and down time of the service line.

SUMMARY OF THE INVENTION

By means of this invention there has been provided a high pressure gas apparatus for expediently driving a clearing nozzle through a clogged line to clear the obstruction. The nozzle is connected to a source of high pressure by a hose which acts as a high pressure gas line to serve in the propulsion of the nozzle to the clogged area and furnish high pressure gas to the clogged area to assist in clearing it and convey the clogged particles rearwardly to free the area of the particles.

The clearing nozzle is specially constructed in the form of a pointed cone-shaped head having a hollow shank adapted to be connected inside the end of the flexible hose which may be constructed of conventional plastic such as polyethylene or the like. The nozzle is provided with a hollow gas chamber provided with a restricted axial passage passing through the pointed end of the nozzle to aid in dislodging clogged particles and a plurality of circumferentially disposed rearwardly directed clearing passages which provide a back pressure and rearwardly directed gas flow which carries the cleared particles rearwardly to free the area.

The apparatus further provides portable means for carrying a source of high pressure gas and a hose carrying system in which a storage reel may be simply carried through difficultly accessible areas to the clogged pipe. A two wheeled hand cart is employed to carry a high pressure gas source such as nitrogen cylinders where a dry inert gas is desireable or compressed air. The hand cart has a main hose reel supported on the frame of the cart and handle for unreeling the hose. In addition a portable auxiliary reel is provided which may be hooked on the hand cart and then hand carried to areas not easily reached by the hand cart such as by ladders, stairs, crawlways or the like.

In use, the hose with the attached nozzle is simply unreeled and fed into an opening in the clogged pipe. The feeding is accomplished by manually pushing the flexible hose which has some degree of stiffness and is physically constrained from bending by the interior of the pipe within which the hose loosely fits. The high pressure gas also aids in the propulsion. The hose may be fed into the pipe a long distance such as one-hundred feet or more until the nozzle reaches the clogged-area. Regularly spaced markings on the hose aid in the determination of the site of the clogged area where this is desirable.

In a modification for clogged areas that are difficult to clear a nozzle may be employed with a burred or fluted rotary head. A main body of the nozzle receives the rotary head in a bearing and rotation is affected by a conventional pneumatic motor or internal vanes on the rotary head which provide the desired rotary movement from the high pressure gas.

The apparatus is convenient to use in its portability and may be employed at a relatively low cost without the necessity of disassembling sections of the clogged pipe to free the clogged area. Down time is significantly lessened while the apparatus may be employed by relatively unskilled workmen in a variety of trouble areas.

The above features are objects of this invention. Further objects will appear in the detailed desription which follows and will be further apparent to those skilled in the art.

For the purpose of illustration of this invention, preferred embodiments thereof are shown in the accompanying drawing. It is to be understood that the drawing is for purpose of description only and that the invention is not limited thereto.

IN THE DRAWING

DESCRIPTION OF THE INVENTION

Figure 1:
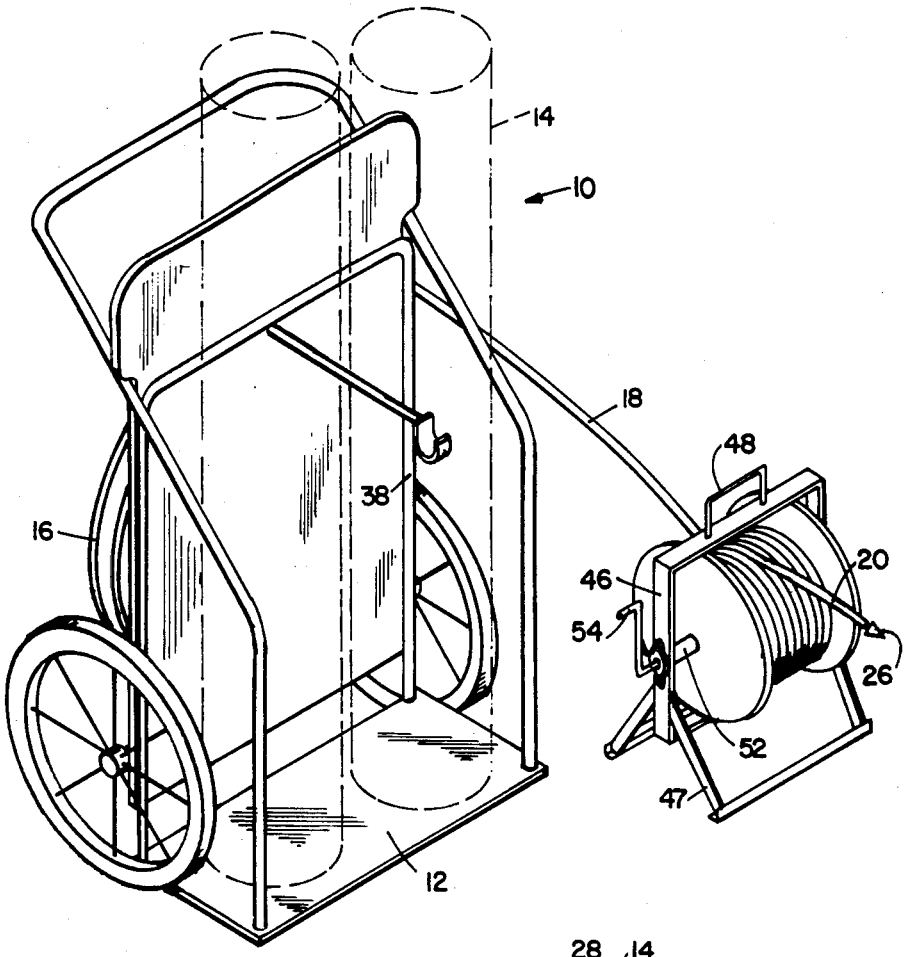
FIG. 1 is a perspective view of the apparatus of this invention.
Figure 2:
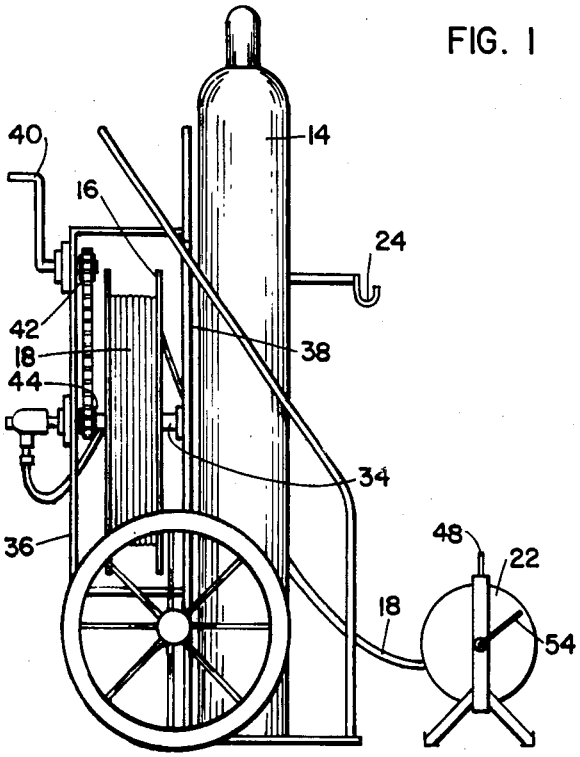
FIG. 2 is a view in side elevation from the left side of FIG. 1.
Figure 3:
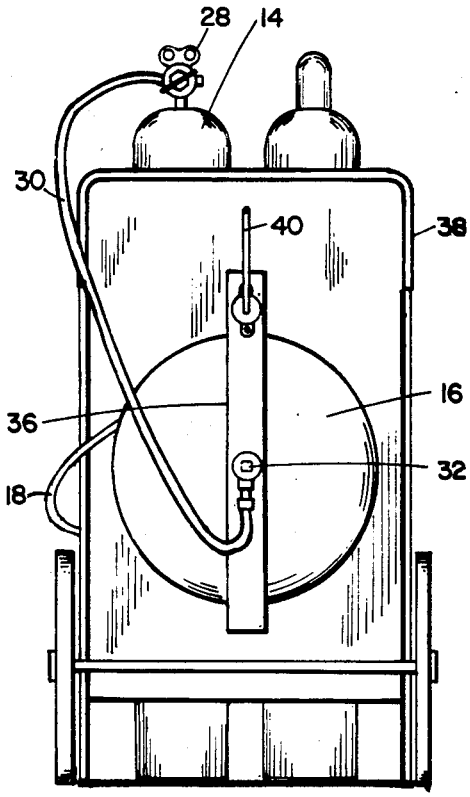
FIG. 3 is a view in rear elevation.

The apparatus of this invention is generally identified by the reference numeral 10 in FIGS. 1, 2 and 3. A two-wheeled hand cart 12 is employed to support the source of the high pressure gas comprising gas cylinders 14. A main hose reel 16 is supported on the frame of the hand cart to supply main hose 18 to a feeder hose 20. The feeder hose is carried on the auxiliary feeder reel 22 hung from a hook 24 of the hand cart. The feeder hose at its free end is connected to the clearing nozzle 26 more particularly shown in FIGS. 4 through 6. The high pressure gas cylinders 14 have a conventional regulator 28 and a supply line 30 connecting the cylinder through a conventional rotary journal 32 to the main hose 18 on the hose reel 16. The reel 16 is supported on a rotary shaft 34 and frame 36 attached to the rear of the cart frame 38. A handle 40 through a sprocket chain connected to sprockets 42 and 44 is used to wind and unwind the hose 18 from the reel.

The auxiliary feeder reel 22 has a frame 46 provided with legs 47 such that as shown in FIGS. 1 and 2 it may be supported on the ground in a remote location away from the hand cart 12. A handle 48 is used for hand carrying and support from the hook 24 of the hand cart in the cart stored position or when the hand cart is moved from one position to another.

The main reel hose 18 is connected to the feeder reel by a conventional rotary journal 50 in the same manner as the journal 32 for the main reel. The feeder hose 20 may be of a lighter construction and smaller size than the main hose to lighten the weight and enhance the portability. As an example, the feeder hose may be one-half inch tubing used to clear a pipe having an internal diameter from five-eights to one inch or so.

The feeder reel is supported from frame 46 on a rotary shaft 52 connecting the rotary journal 50 and one end of the feeder hose. A hand crank 54 is used to facilitate unwinding and rewinding the feeder hose.

Figure 4:
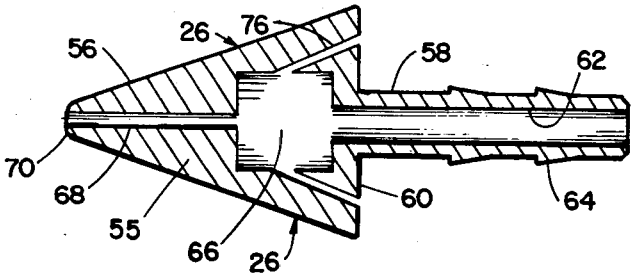
FIG. 4 is a view in axial section of the nozzle.
Figure 5:
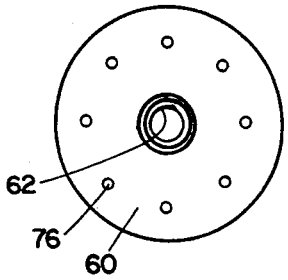
FIG. 5 is a view in rear elevation of the nozzle.
Figure 6:
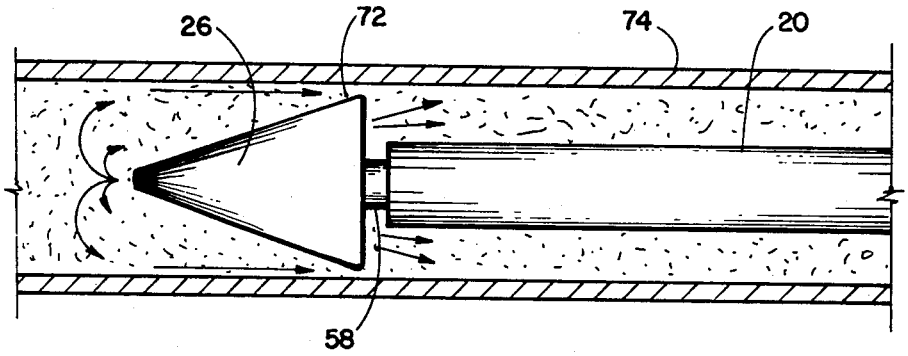
FIG. 6 is a view partly in section showing the nozzle in operative condition inside a pipe to be cleaned.

The clearing nozzle 26 is best shown in FIG. 4 through 6. It is comprised of an integral metallic body 55 having a coneshaped head portion 56 and a hollow shank 58 extending rearwardly from a base 60 of the head. The shank 58 has a gas passage 62 communicating with the feeder hose 20. It is provided with exterior barbs 64 in order that it may be friction fitted and retained in the end of the feeder hose.

The cone head portion is provided with a central plenum or gas chamber 66 from which extends a narrow axial gas passage 68 through a pointed nose 70. This passage delivers a jet of high pressure gas which with the contact of the nose portion against clogged material provides a clearing force to disperse the clogged particles past a clearing passage 72 between the interior of the material handling pipe 74 and the exterior of the clearing nozzle 26 as shown in FIG. 6.

The clearing nozzle is further provided with a plurality of circumferentially disposed rearwardly directed clearing passages 76 extending from the plenum chamber 66 through the base 60 of the cone shaped head portion of the clearing nozzle. These passages provide a rearwardly directed high pressure gas stream around the inner periphery of the pipe 74 to form a venturi or aspirating force rearwardly directed as shown in FIG. 6 to assist the movement of the cleared particles away from the clogged area.

Figure 7:
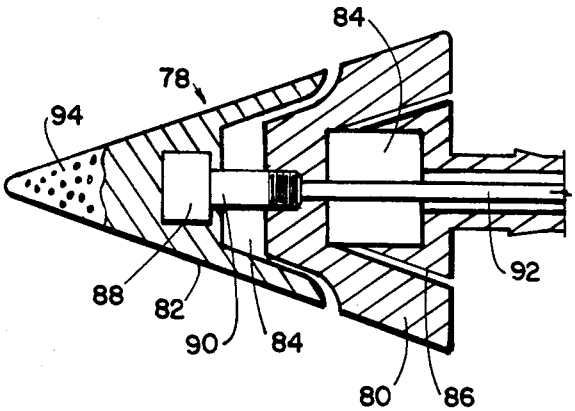
FIG. 7 is a view partly in axial section showing a modified nozzle employing a rotary head.
Figure 8:
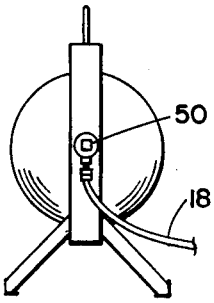
FIG. 8 is a fragmentary view in elevation from the right side of FIG. 1 showing the large hose connection from the main reel to the portable reel.

A modification 78 of the clearing nozzle is shown in FIG. 7. In this embodiment the nozzle is provided with a stationary base portion 80 and a cone-shaped rotary head 82. The base 80 has a plenum chamber 84 as in the nozzle 26 and circumferentially disposed rearwardly directed clearing passages 86. A conventional pneumatic motor 88 is connected by a shaft 90 to the base portion. It has conventional vanes or the like in communication with a high pressure gas line 92 which provides rotary motion to the rotary head 82. The exterior surface of the rotary head is provided with burrs 94, cutting flutes or the like to assist in abrading or cutting the clogged material for clearing the obstruction. It will be understood that where desired an axial passage may be employed for delivering a high pressure gas jet through the nose portion of the rotary head and that instead of the separate high pressure gas line 92, high pressure gas from the plenum chamber 84 may be employed to power the rotary head 82.

USE

The clearing apparatus of this invention is very simply employed in the field. The portability of the two-wheeled hand cart 12 makes it convenient for rolling to the desired location. For difficultly accessible or remote areas the auxiliary reel 22 may be hand carried to the desired site.

The main reel 16 which may be provided with a heavier hose 18 than the feeder hose 20 is readily played out by the handle or hand crank 40 and with the added length of the feeder hose 20 a considerable working length is provided to reach a clogged area in the pipe 74 that may be a hundred feet or considerably more from the hand cart base.

In operation the gas cylinder 14 may desirably be high pressure nitrogen which is dry and inert. The cylinder is adjusted by the regulator 28 to provide a high pressure of 150 pounds per square inch to the hose 18 and the feeder hose 20 which is connected at its free end to the clearing nozzle 26. The feeder hose is then manually fed into the pipe 74 assisted by the propulsion effect of the high pressure gas acting against the clearing nozzle. It will also be understood that the feeder hose may be fed to the clogged area and the high pressure gas line turned on as the obstructed area is reached where desired for conservation of gas.

When the clogged area is reached with the high pressure gas turned on the combined force of the thrust of the nose portion against the clogged area and the high pressure gas jet from passage 68 act to disperse the clogged particles. The aspirating force of the gas from passages 76 and the gas from passage 68 as shown in FIG. 6 clear the dispersed particles from the obstructed area rearwardly. Some pipes are provided with slots slanted toward the normal flow direction for introduction of air and the cleared particles may fall there through.

After the clogged area has been cleared the feeder hose may be simply rewound by the hand crank 54 and the main hose is similarly rewound by the handle 40. The auxiliary reel is then supported by the hook 24 and the entire unit may be stored for futher use as required.

For clearing obstructions that are more severely clogged or packed the rotary clearing nozzle 78 may be used to replace the nozzle 26. The nozzle 26 may be physically withdrawn or the feeder hose 20 may be cut to insert the nozzle 78. The rotary force of the rotary head portion 82 effected by the abrading action of the burrs 94 enhances the breaking up of the clogged area for efficient dispersion. The rearward movement of the clogged particles is effected by the aspirating force of the jet passages 86 in the same manner as for the nozzle 26.

Various changes and modifications may be made within this invention as will be apparent to those skilled in the art. Such changes and modifications are within the scope and traching of this invention as defined in the claims appended hereto.

What is claimed is:

1. Apparatus for clearing an obstruction of clogged discrete particles in a pipeline or the like, said apparatus comprising a flexible hose connected at one end to a source of high pressure gas, said hose being freely insertable into said pipeline and being connected at a second end to an obstruction clearing nozzle, means for regulating the gas source to a selcected pressure, said nozzle having means for connecting it at a rear end to said hose and having a forward portion adapted to contact said obstruction forcefully to dislodge said particles and said nozzle having a gas introduction passage at the rear communicating with said hose and rearwardly directed aspirating gas passage means creating a rearwardly directed gas flow for carrying dispersed particles from the clogged area, said nozzle having a forwardly directed configuration with a transverse rear base and a plenum chamber communicating with said gas introduction passage and said aspirating gas passage means, said nozzle having a stationary rear base connected to a separate rotary cone-shaped head and said head having gas driven powering means, said head being further provided with comminuting elements on the cone-shaped surface and said gas aspirating gas passage means comprising a plurality of circumferentially disposed gas passages extending from said plenum chamber through said base.

2. The apparatus of claim 2 in which an axial gas passage means is in communication with said high pressure gas at one end and extends at another end through a forward nose portion of said nozzle to facilitate the dispersion of said clogged particles and provide a back flow to carry said particles rearwardly of the nozzle away from the clogged area and past a restricted passage defined by an enlarged base of the cone-shaped forward portion of the nozzle and the interior of the pipeline where a high velocity aspirating flow is created.

3. The apparatus of claim 3 in which a rearwardly extending hollow shank portion extends from the transverse base and is insertable in fixed relation within an end of said hose.

4. Apparatus for clearing an obstruction of clogged discrete particles in a pipeline or the like, said apparatus comprising a flexible hose connected at one end to a source of high pressure gas, said hose being freely insertable into said pipeline and being connected at a second end to an obstruction clearing nozzle, means for regulating the gas source to a selected pressure, said nozzle having means for connecting it at a rear end to said hose and having a forward portion adapted to contact said obstruction forcefully to dislodge said particles and said nozzle having a gas introduction passage at the rear communicating with said hose and rearwardly directed aspirating gas passage means creating a rearwardly directed gas flow for carrying dispersed particles from the clogged area, a mobile cart being provided for support of high pressure gas cylinders comprising the source of said high pressure gas, said cart having a vertical frame supporting a main hose reel and said cart further removably supporting a portable auxiliary feeder hose reel which can be hand carried to a site removed from said cart.

5. The apparatus of claim 4, in which an axial gas passage means is in communication with said high pressure gas at one end and extends at another end through a forward nose portion of said nozzle to facilitate the dispersion of said clogged particles.

6. The apparatus of claim 4 in which said high pressure cylinder is connected to a hose reel and handle means are provided for reeling in and out a main hose from said main reel, means connecting said main hose to said auxiliary feeder hose reel and said feeder hose reel having handle means for carrying it to a clogged pipeline site.

7. The apparatus of claim 6 in which said feeder reel is further provided with a hand crank for reeling in and out said feeder hose and said vertical frame has a hook member receiving the auxiliary reel in a supported relation whereby the cart and main and auxiliary reels may be moved as a unit.

8. The apparatus of claim 4 in which said feeder hose has a diameter and stiffness such that it may be manually fed into a pipe.

9. The apparatus of claim 4 in which said feeder hose has a diameter and stiffness such that it may be manually fed into a pipe, said nozzle having a forwardly directed configuration with a transverse rear base and a plenum chamber communicating with said gas introduction passage and said aspirating gas passage means.

10. The apparatus of claim 1 in which said plenum chamber is situated within said stationary rear base and is provided with separate outlets communicating with said aspirating gas passage means and said gas driven powering means.

* * * * *